United States Patent [19]

Ray et al.

[11] 4,405,368

[45] Sep. 20, 1983

[54] IRON-ALUMINUM ALLOYS CONTAINING BORON WHICH HAVE BEEN PROCESSED BY RAPID SOLIDIFICATION PROCESS AND METHOD

[75] Inventors: Ranjan Ray, Waltham; Viswanathan Panchanathan, Billerica; Bill C. Giessen, Cambridge, all of Mass.

[73] Assignee: Marko Materials, Inc., No. Billerica, Mass.

[21] Appl. No.: 261,626

[22] Filed: May 7, 1981

[51] Int. Cl.[3] ..... F16H 29/10

[52] U.S. Cl. ..... 75/124; 75/123 B; 75/251; 148/442; 420/581; 428/606

[58] Field of Search ..... 75/123 B, 124 F, 134 F, 75/134 V, 251, 124 A, 124 B, 124 C, 124 E; 428/606; 420/581; 148/442

[56] References Cited

U.S. PATENT DOCUMENTS

| | | | |
|---|---|---|---|
| Re. 29,989 | 5/1979 | Polk et al. | 75/134 F |
| Re. 30,106 | 10/1979 | Polk et al. | 75/134 F |
| 1,493,191 | 5/1924 | DeGolyer | 75/123 B |
| 4,052,201 | 10/1977 | Polk et al. | 75/134 F |
| 4,197,146 | 4/1980 | Frischmann | 75/251 |
| 4,236,946 | 12/1980 | Aboaf et al. | 75/123 B |
| 4,264,358 | 4/1981 | Johnson et al. | 75/134 V |
| 4,297,135 | 10/1981 | Giessen et al. | 75/170 |

OTHER PUBLICATIONS

Metallic Glasses, American Society for Metals, 1978 p. 31.

*Primary Examiner*—John P. Sheehan
*Attorney, Agent, or Firm*—Morse, Altman & Dacey

[57] ABSTRACT

New iron base alloys containing aluminum and boron are disclosed. The alloys are subjected to a rapid solidification processing (RSP) technique which produces cooling rates between $\sim 10^5$ to $10^7$° C./sec. The as-quenched ribbon or powder, etc consists primarily of a metastable crystalline solid solution phase. The metastable crystalline phases are subjected to suitable heat treatments so as to produce a transformation to a stable multiphase microstructure which includes borides. The heat treated alloy exhibits superior mechanical properties with good corrosion and oxidation resistance.

8 Claims, No Drawings

IRON-ALUMINUM ALLOYS CONTAINING BORON WHICH HAVE BEEN PROCESSED BY RAPID SOLIDIFICATION PROCESS AND METHOD

BACKGROUND OF THE INVENTION

1. Field of the Invention

This invention relates to new rapidly solidified iron base alloys containing aluminum and boron. This invention also relates to the preparation of these materials in the form of rapidly solidified powder and consolidation of these powders (or alternatively the rapidly solidified ribbon-like material) into bulk parts which are suitably heat treated to have desirable properties.

2. Description of the Prior Art

Rapid solidification processing (RSP) techniques offer outstanding prospects of new cost effective engineering materials with superior properties. [See Proc. Int. Conf. On Rapid Solidification Processing; Reston, Va., 1980; Published by Claitors Publishing Division, Baton Rouge, La.]. Metallic glasses, microcrystalline alloys, supersaturated solid solutions and ultrafine grained alloys with highly refined microstructures, in each case, often having complete chemical homogeneity are some of the products that can be made utilizing RSP. [See Rapidly Quenched Metals, 3rd Int. Conf. Vols. 1 and 2, Cantor Ed; The Metals Society, London, 1978].

Several techniques are well established in the state of the art to economically fabricate rapidly solidified alloys (at cooling rates of $\sim 10^5$ to $10^7$° C./sec) as ribbons, filaments, wires, flakes or powders in large quantities. One well known example is melt spin chill casting whereby the metal is spread as a thin layer on a conductive metallic substrate moving at higher speed to form rapidly solidified ribbon. [See Proc. Int. Conf. on Rapid Solidification Processing, Reston, Va., 1977].

The design of alloys made by conventional slow cooling process is largely influenced by the corresponding equilibrium phase diagrams which indicate the existence and coexistence of the phases present in thermodynamic equilibrium. Alloys prepared by such processes are in or at least near equilibrium. The advent of rapid quenching from the melt has enabled material scientists to stray further from the state of equilibrium and has greatly widened the range of new alloys with unique structure and properties availabel for technological application.

Heat and corrosion resistant alloys are capable of sustained operation without corrosion and oxidation when exposed either continuously or intermittently up to or in excess of 1200° F. They find extensive applications in metallurgical furnaces, cement mill equipment, oil refineries, petrochemical furnaces, steel mill equipment, power plant equipment, etc. [refer Source Book on Material Selection, Vol. 2, ASM, p. 39, 1977]. These alloys invariably contain large amounts of chromium and nickel for which the country is dependent on imports to meet its requirement.

Certain drawbacks of the current heat resistant alloys are that they contain substantial amount of chromium which is in short supply because of limited reserves of mineral deposits.

Alloys based primarily on iron and aluminum, relatively inexpensive elements with abundant and more secure reserves, offer excellent alternative possibilities to the current heat resistant alloys containing chromium, nickel and/or cobalt. Iron-aluminum alloys exhibit outstanding oxidation resistance and were considered as potential candidates for a wide variety of heat resistant applications ranging from turbines to components for industrial furnaces. (See E. R. Morgan and V. F. Zackay, Metal Progress, Vol. 68, No. 4, p. 126, 1955 and Journal Iron and Steel Institute, Vol. 130, 1934, p. 389). However, the room temperature brittleness of these alloys has retarded their application. Iron-aluminum alloys containing 13 wt% (24 at %) aluminum, as necessary for adequate high temperature oxidation resistance between 1600° and 2000° F., have poor room temperature mechanical properties, i.e. low tensile strength and poor ductility. It has been suggested that brittleness of Fe-Al alloys with aluminum content generally greater than 13–14 wt% (24–26 at %) is caused in part by the occurrence of ordering. (see W. V. Justusson, V. F. Zackay, and E. R. Morgan, Trans ASM, Vol. 49, pp. 905–923, 1957). Fe-Al-C alloys with 2.1 wt% carbon containing 20.45 wt% aluminum have been reported to have good resistance to internal oxidation upon exposure at 1600° and 1800° F., but these alloys were reported to have negligible ductility and low tensile strength (see J. A. Yater et al, AFS Transactions, Vol. 113, 1976, p. 305).

Recent efforts to obtain improved strength and ductility combined with good corrosion and oxidation resistance in Fe-Al alloys resulted in the development of alloys containing 13 wt% ($\sim$24 at%) aluminum, 1 to 1.5 wt% titanium and 0.5 to 0.7 wt% boron which were compacted from rapidly solidified powders (see E. R. Slaughter et al, Report AFML-TR-79-4167, Nov. 1979).

Binary iron-aluminum alloys have a strong susceptibility to microcracking during the ingot casting operation due to low thermal conductivity and high thermal expansivity. This charactteristic feature, coupled with large grain growth at high temperatures, renders hot working iron aluminum alloys difficult. Furthermore, air melting or iron aluminum alloys containing high aluminum contents results in the formation of embrittling grain boundary oxide films which accentuate the tendency for intergranular fracture of the ingots during subsequent hot working operation (see W. Justusson et al, Trans ASM, Vol. 49, pp. 905–923, 1957).

There has been limited efforts, as reported in the prior art, involving the use of RSP techniques to synthesise new iron-aluminum alloys containing >20 at% aluminum with unique chemical composition and microstructures exhibiting superior mechanical properties and corrosion and/or oxidation resistance for numerous industrial/engineering applications.

SUMMARY OF THE INVENTION

This invention features a class of iron base alloys, containing aluminum and boron, having excellent corrosion and oxidation resistance combined with high hardness and strength when the production of these alloys includes a rapid solidification process. These alloys can be described by the general formula $$Fe_aAl_bM_cM_d{}^1Si_eB_f\text{—[A]}$$

wherein Fe, Al, Si and B respectively represent iron, aluminum, silicon and boron, M is one or more of the elements copper (Cu), nickel (Ni) and chromium (Cr), M′ may be one of the elements molybdenum (Mo), tungsten (W), niobium (Nb), tantalum (Ta) and vanadium (V) either singly or combined, and a, b, c, d, e, and f represent atom percent of Fe, Al, M, M', Si and B, respectively, and have the following values, a=40–70
b=20–40
c=0–10
d=0–10
e=0–5
f=5–17 with the provisos that (i) the sum of (c+d) may not exceed 15, (ii) the sum of (e+f) may not exceed 17, (iii) the sum of (e+f) can not be less than 7, and, (iv) the sum of (a+b+c+d+e+f) is 100. Unless otherwise specified, all subscripts given herein are in atom present.

Rapid solidification processing (RSP) [i.e. processing in which the liquid alloy is subjected to cooling rates of the order of $10^5$ to $10^7$° C./sec] of such alloys produced a metastable crystalline structure which is chemically homogeneous and can be heat treated and/or thermomechanically processed so as to form the dispersion of borides and/or silicides. The as-quenched metastable alloy prepared as "ribbons" by melt spinning technique is brittle and is readily comminuted to a staple or powder using standard pulverisation techniques (e.g.) a rotating hammer mill. The powder or staple is consolidated into bulk shapes using conventional methods, for example, hot extrusion or cold pressing and sintering. The heat treatment to precipitate the strengthening borides and/or silicides can be done prior to, during or subsequent to consolidation. The final transformed product is tough with good mechanical properties.

DETAILED DESCRIPTION OF THE PREFERRED EMBODIMENTS

The melt spun method includes any of the processes such as single roll chill block casting, double roll quenching, melt-extraction, melt drag etc., where a thin layer of liquid metal is brought in contact with a solid substrate.

Other rapidly solidified powder processing methods such as forced convective cooling of atomized droplets known in the art, can be used to make rapidly solidified powders of the present alloys and such powders can be subsequently powder metallurgically consolidated into bulk parts and/or heat treated for optimised microstructure, mechanical properties etc.

DETAILED DESCRIPTION OF THE INVENTION

In accordance with the present invention iron base alloys containing 20 to 40 atom percent aluminum are further alloyed with 5 to 17 atom percent of boron. The alloys are optionally alloyed with one or more of the following elements; 0 to 10% of Cu, Ni and Cr, either singly or combined, 0 to 10% of Mo, W, Nb, Ta and V, either singly or combined, and 0–5% of Si. The alloys may also contain limited amounts of other elements which are commercially found in iron base alloys without changing the essential behavior of the alloys. Typically examples include $Fe_{48}Al_{35}B_{17}$, $Fe_{50}Al_{33}B_{17}$, $Fe_{50}Al_{35}Si_5B_{10}$, $Fe_{45}Al_{30}Mo_5Ni_5Si_5B_{10}$, $Fe_{40}Al_{30}Cu_5Ni_5Mo_2V_3Si_5B_{10}$ and $Fe_{50}Al_{25}Ni_{10}Mo_2Ta_1Nb_1W_1B_{10}$.

The alloys of the present invention, upon rapid solidification processing from the melt by melt spin chill casting at cooling rates of the order of $10^5$ to $10^7$ ° C/sec, form brittle ribbons consisting predominantly of a single solid solution phase with high degree of compositional uniformity. The brittle ribbons are readily pulverised into powders having particle size less than 100 U.S. mesh using standard comminution techniques. The powder is consolidated into bulk parts, e.g. disks, plates, bars, etc. using powder metallurgical techniques (e.g.) hot extrusion, hot isostatic pressing, hot forging, hot rolling, etc., optionally followed by heat treatment for optimised properties. The bulk alloys contain finely dispersed borides and/or silicides within an iron-rich matrix, such material being tough and having high hardness and strength compared to conventional iron-base alloys.

When the alloys within the scope of the present invention are solidified by conventional slow cooling processes, they have relatively coarse grains and hence lesser mechanical properties. In contrast, when the alloys are made using RSP techniques followed by heat treatment at high temperatures, preferably between 800° to 950° C. for 0.1 to 100 hrs. the precipitation of ultrafine borides takes place, these borides having an average particle size of ~0.5 micron, preferably 0.05 micron, being finely dispersed both intergranularly and intragranularly. Typically, the matrix grains have a size less than 10 microns, preferably less than 2 microns.

The fully heat treated RSP alloys of the present invention exhibit high hardness and high strength. The alloys of the present invention have hardness values of 350 to 720 Kg/mm$^2$ corresponding to 150 to 300 Ksi. In comparison, the standard stainless and heat resisting steels have a maximum hardness of 350 Kg/mm$^2$.

The boron content of the present alloys is critical. When the boron content is less than 5% the alloys are difficult to form as rapidly solidified ribbons by the method of melt deposition on a rotating chill substrate (i.e.) melt spinning. This is due to the inability of the alloy melts with low boron contents to form a stable molten pool on the quench surface. Such alloys do not readily spread into a thin layer on a rotating substrate as required for melt spinning.

When the boron content is greater than 17% it becomes difficult to form a solid solution phase. The heat treated alloys are very brittle containing excessive amounts of brittle boride phases exhibiting poor mechanical properties.

Of particular interest in these alloys are the increased strength and hardness combined with good corrosion and oxidation resistance. Also, these alloys do not contain chromium which is in short supply because of limited mineral reserves.

The alloys of the system Fe-Al-B with B contents between 13 to 17 atom percent prepared in accordance with the present invention belong to a preferred group of alloys. These alloys are described by the formula $Fe_{48-62}Al_{25-35}B_{13-17}$. Examples include $Fe_{48}Al_{35}B_{17}$, $Fe_{55}Al_{30}B_{15}$, $Fe_{50}Al_{35}B_{15}$, and $Fe_{60}Al_{25}B_{15}$.

The above alloys upon rapid quenching by melt spinning form extremely brittle ribbons consisting of single solid solution phase. The quenched alloys may additionally contain borides dispersed in the matrix. Upon heat treatment at 900° C. for 2 hrs. the precipitation of ultrafine borides takes place both intergranularly and intragranularly. After such heat treatment the above alloys exhibit improved toughness i.e. ductility and possess relatively high hardness values between 350 to 400 Kg/mm$^2$.

Another preferred class of alloys is based on the system Fe-Al-Si-B. This class is defined by the general formula $Fe_{50-68}Al_{25-35}Si_{2-5}B_{5-10}$. Typical examples include $Fe_{50}Al_{35}Si_5B_{10}$. $Fe_{60}Al_{25}Si_5B_{10}$, $Fe_{60}Al_{30}Si_5B_5$ and $Fe_{65}Al_{25}Si_5B_5$.

The ribbons obtained by melt spinning are brittle which upon heat treatment at 900° C. shown significantly improved ductility with typical hardness values ranging between 520 to 640 Kg/mm$^2$.

Another preferred class of alloys which is obtained by the addition of molybdenum to Fe-Al-Si-B alloy is described by the formula, $Fe_{40-60}Al_{25-35}Mo_{5-10}Si_{0-5}B_{10-15}$, with the provisos that the sum of (B+Si) may not exceed 15. Typical examples include $Fe_{45}Al_{35}Mo_5Si_5B_{10}$, $Fe_{50}Al_{30}Mo_{10}B_{10}$, $Fe_{50}Al_{25}Mo_{10}Si_5B_{10}$, and $Fe_{55}Al_{30}Mo_5B_{10}$.

The above alloys when processed by the method described in the present invention exhibit very high hardness, up to 720 Kg/mm$^2$ and hence high tensile strength.

EXAMPLES 1 TO 3

Alloys of the present invention upon melt spinning form very brittle ribbons which become tough upon heat treatment at high temperatures. The toughness of melt-spun ribbons can be readily characterized by the bend test wherein the metallic ribbon is bent to form a loop and the diameter of the loop is gradually reduced until the ribbon fractures. The smaller the breaking diameter for a given ribbon thickness, the toughness the ribbon is considered to be. Table 1 gives compositions of selected alloys along with the typical values of hardness and breaking diameters of the ribbons in as-quenched state and after heat treatment.

TABLE 1

| Example | Alloy Composition (atom percent) | As-Quenched Ribbon Hardness Kg/mm$^2$ | As-Quenched Ribbon Breaking dia (inch) | Heat Treated (900° C. for 2 hrs) Ribbon Hardness (Kg/mm$^2$) | Heat Treated (900° C. for 2 hrs) Ribbon Breaking dia (inch) |
|---|---|---|---|---|---|
| 1 | $Fe_{52}Al_{35}B_{13}$ | 972 | 0.30 | 352 | 0.02 |
| 2 | $Fe_{48}Al_{32}Mo_8B_{12}$ | 840 | 0.20 | 450 | 0.02 |
| 3 | $Fe_{60}Al_{30}Si_3B_7$ | 600 | 0.15 | 520 | 0.01 |

EXAMPLES 4 TO 12

Selected Fe-Al alloys were alloyed with boron, silicon and molybdenum. Typical examples are given in Table 2. These alloys were melt spun as brittle ribbons having thicknesses of 25 to 75 microns by RSP method of melt spinning using a Cu-Be cylinder having a quench surface speed of ~5000 ft/min. The ribbons were found by X-ray diffraction analysis to consist predominantly of a single solid solution phase. The brittle ribbons were pulverized into powder under 100 mesh or staple using a rotating hammer mill.

TABLE 2

| Example | Alloy Composition (atom percent) |
|---|---|
| 4 | $Fe_{55}Al_{30}B_{15}$ |
| 5 | $Fe_{55}Al_{32}B_{13}$ |
| 6 | $Fe_{48}Al_{35}B_{17}$ |
| 7 | $Fe_{53}Al_{30}B_{17}$ |
| 8 | $Fe_{48}Al_{30}Mo_7B_{15}$ |
| 9 | $Fe_{45}Al_{30}Mo_{10}Si_3B_{12}$ |
| 10 | $Fe_{43}Al_{35}Mo_8Si_2B_{12}$ |
| 11 | $Fe_{55}Al_{35}Si_2B_8$ |
| 12 | $Fe_{60}Al_{30}Si_5B_5$ |

EXAMPLES 13 TO 19

A number of iron-aluminum alloys containing boron were prepared as brittle RSP ribbons in 50 to 100 grams quantity in accordance with the present invention. Typical compositions of the alloys are given in Table 3. Upon heat treatment at 900° C. for 2 hours the melt spun ribbons became tough i.e. exhibited smaller breaking diameter in bend test and had hardness values ranging from 350 to 720 Kg/mm$^2$.

TABLE 3

| Example | Alloy Composition (atom percent) | Hardness of Heat Treated Ribbon (Kg/mm$^2$) |
|---|---|---|
| 13 | $Fe_{52}Al_{35}B_{13}$ | 350 |
| 14 | $Fe_{53}Al_{32}B_{15}$ | 380 |
| 15 | $Fe_{50}Al_{35}B_{15}$ | 400 |
| 16 | $Fe_{50}Al_{33}Mo_5B_{12}$ | 720 |
| 17 | $Fe_{48}Al_{32}Mo_8B_{12}$ | 450 |
| 18 | $Fe_{56}Al_{32}Si_3B_9$ | 640 |
| 19 | $Fe_{60}Al_{30}Si_3B_7$ | 520 |

EXAMPLE 20

A number of alloy ribbons were subjected to corrosion and oxidation tests. The tests and the results are tabulated in Table 4. The compositions of the alloys investigated are (i) $Fe_{52}Al_{35}B_{13}$ (ii) $Fe_{53}Al_{32}B_{15}$ (iii) $Fe_{60}Al_{30}Si_3B_7$ (iv) $Fe_{56}Al_{32}$ $Si_3B_9$ (v) $Fe_{50}Al_{33}Mo_5B_{12}$ and (vi) $Fe_{48}Al_{32/}$ $_{Mo8}B_{12}$.

TABLE 4

| TEST | RESULTS |
|---|---|
| (a) Exposure to indoor atmosphere for 1000 hours | Had excellent resistance without sign of discoloration or tarnish |
| (b) Exposure to outdoor atmosphere for 1000 hours | Had excellent resistance without sign of discoloration or tarnish |
| (c) Exposed at 900° C. for 16 hours | Did not show any trace of oxidation as evidenced by lack of oxide scale formation |
| (d) Kept in 5 wt % sodium chloride solution for 120 hours | Did not show any corrosion as evidenced by the clear surface |

EXAMPLE 21

The following example illustrates an economical method of production of RSP powder of the boron modified iron-aluminum alloys of the composition indicated in (A) with the present invention.

The iron base alloys are melted in any of the standard melting furnaces. The melt is transferred via a ladle into a tundish having a series of orifices. A multiple number of jets are allowed to impinge on rotating water cooled copper-beryllium drums whereby the melt is rapidly solidified as ribbons. The ascast brittle ribbons are directly fed into a hammer mill of appropriate capacity wherein the ribbons are ground into desirable size ranges.

While the invention has been described with particular reference to the specific embodiments, numerous modifications thereto will appear feasible to those skilled in the art.

Having thus described the invention, what we claim and desire to obtain by Letters Patent of the United States is:

1. A metastable crystalline solid solution alloy of composition $Fe_aAl_bM_d^1Si_eB_f$ where $M^1$ is at least one element selected from the group consisting of Mo,W,Nb,Ta, and V and combinations thereof, wherein the subscripts represent atom percent having the values a=40–65, b=20–40, d=0–10, e=0–5, and f=5–17 with the provisos that the sum of e+f does not exceed 17 and is not less than 7 and the sum of a+b+d+e+f is 100, wherein the said alloy is being prepared by the method comprising the following steps:

a. forming a melt of said alloy b. depositing said melt against a rapidly moving quench surface adapted to quench said melt at a rate in the range of approximately $10^5$ to $10^7$° C./second and form thereby a rapidly solidified brittle strip and, c. comminuting said strip into powders.

2. The alloy of composition of claim 1 in the form of a body having fine grained microstructure and a thickness of at least 0.1 mm measured in the shortest dimension.

3. The alloy of claim 1 having the composition $Fe_{48-62}Al_{25-35}B_{13-17}$ wherein the sum of atom percent of Fe,Al, and B is 100.

4. The alloy of composition of claim 3 in the form of a body having fine grained microstructure and a thickness of at least 0.1 mm measured in the shortest dimension.

5. The alloy of claim 50 having the composition $Fe_{50-65}Al_{25-35}Si_{2-5}B_{5-10}$ with the provisos that the sum of atom percent of Fe,Al,Si and B is 100.

6. The alloy of composition of claim 5 in the form of a body having fine grained microstructure and a thickness of at least 0.1 mm measured in the shortest dimension.

7. The alloy of claim 1 having the composition $Fe_{40-60}Al_{25-35}Mo_{5-10}Si_{0-5}B_{10-15}$ with the provisos that the atom percent of B+Si may not exceed 15 and the sum of atom percent of Fe,Al,Mo,Si, and B is 100.

8. The alloy of composition of claim 7 in the form of a body having fine grained microstructure and a thickness of at least 0.1 mm measured in the shortest dimension.

* * * * *